US007798211B2

(12) United States Patent
Brown et al.

(10) Patent No.: US 7,798,211 B2
(45) Date of Patent: Sep. 21, 2010

(54) PASSIVE GAS SEPARATOR FOR PROGRESSING CAVITY PUMPS

(75) Inventors: Donn J. Brown, Tulsa, OK (US); Brown Lyle Wilson, Tulsa, OK (US); Roger D. Stair, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 64 days.

(21) Appl. No.: 12/125,160

(22) Filed: May 22, 2008

(65) Prior Publication Data

US 2009/0288818 A1 Nov. 26, 2009

(51) Int. Cl.
*E21B 43/38* (2006.01)

(52) U.S. Cl. ..... 166/105.5; 166/265

(58) Field of Classification Search ..... 166/369, 166/265, 105.5; 96/155; 95/260
See application file for complete search history.

(56) References Cited

U.S. PATENT DOCUMENTS

| | | | | |
|---|---|---|---|---|
| 2,104,339 | A | 1/1938 | Arutunoff | |
| 3,175,501 | A * | 3/1965 | Carle | 415/169.1 |
| 4,913,630 | A * | 4/1990 | Cotherman et al. | 417/313 |
| 5,113,937 | A | 5/1992 | Cholet | |
| 5,525,146 | A * | 6/1996 | Straub | 96/214 |
| 6,257,333 | B1 | 7/2001 | Mann et al. | |
| 6,554,066 | B2 | 4/2003 | Lopes et al. | |
| 6,705,402 | B2 | 3/2004 | Proctor | |
| 6,715,556 | B2 | 4/2004 | Mack et al. | |
| 2002/0096327 | A1 | 7/2002 | Kobylinski et al. | |
| 2004/0060705 | A1 | 4/2004 | Kelley | |
| 2005/0241826 | A1 | 11/2005 | Pratt | |

* cited by examiner

*Primary Examiner*—Shane Bomar
(74) *Attorney, Agent, or Firm*—Bracewell & Giuliani LLP

(57) ABSTRACT

An electrical submersible well pump assembly having a progressing cavity pump, a pump motor, a flex shaft connecting the pump motor to the pump, and a gas/liquid separator on the inlet to the pump. An inner and outer housing circumscribe a portion of the flex shaft, each having fluid inlets. The fluid inlets on the outer housing are above the inner housing inlets and an annulus is formed between the inner and outer housing. Wellbore fluid enters the assembly through the outer housing inlets, flows downward through the annulus, and into the inner housing inlets. Gas separates from the liquid as the fluid flows downward from the outer housing inlets to the inner housing inlets.

13 Claims, 3 Drawing Sheets

PASSIVE GAS SEPARATOR FOR PROGRESSING CAVITY PUMPS

FIELD OF THE INVENTION

This invention relates in general to electrical submersible well pumps, and in particular to a gas separator provided on the pump inlet of a progressing cavity pump.

BACKGROUND OF THE INVENTION

When an oil well is initially completed the downhole pressure may be sufficient to force the well fluid up the well tubing string to the surface. The downhole pressure in some wells decreases over time, and some form of artificial lift is required to get the well fluid to the surface. One form of artificial lift involves suspending a centrifugal electric submersible pump (ESP) downhole in the tubing string. The ESP provides the extra lift necessary for the well fluid to reach the surface. An ESP has a large number of stages, each stage having an impeller and a diffuser. In gassy wells, or wells which produce gas along with oil, there is a tendency for the gas to enter the pump along with the well fluid. Gas in the pump decreases the volume of oil transported to the surface, decreases the overall efficiency of the pump, and reduces oil production.

A progressing cavity pump is another type of well pump which typically comprises a helical metal rotor rotating inside a correspondingly formed helical elastomeric stator. The liquid being pumped lubricates the contact surface between the helical rotor and the stationary stator. Gas entering the pump not only reduces its pumping efficiency, but also prevents the liquid from continuously lubricating the rotor and stator surfaces while being forced through the pump. The stator deteriorates quicker when not lubricated, thereby increasing pump maintenance and repair frequency.

One example of a prior art progressing pump assembly 10 is shown in a side partial cross sectional view in FIG. 1. Pump assembly 10 is suspended from tubing 12 in a well in order to pump well fluid to the surface through the tubing 12. Pump assembly 10 includes a progressing cavity pump 14 having a helically shaped rotor 16 rotating within an elastomeric stator 18. An inlet 20 is located at the lower portion of progressing pump 14 where liquids enter pump 14. An outlet 24 is located at the upper portion of progressing cavity pump 14 for discharging the liquids up the string of tubing. Liquids entering pump 14 flow into a double helical cavity 22 between rotor 16 and stator 18. Rotor 16 rotates so that the helical shape of rotor 16 and stator 18 force liquid to travel up pump 14. The liquid in cavity 22 is forcibly moved as portions of cavity 22 rise along rotor 16 to outlet 24, where the liquid is discharged above pump 14 into the string of tubing 12 leading to the surface. The liquid leaves a thin layer of liquid on the surfaces of rotor 16 and stator 18 as the liquid in cavity 22 travels up rotor 16 through pump 14. The thin layer of liquid left on the surfaces of rotor 16 and stator 18 acts as a lubricant, increasing the operational lifespan of rotor 16 and stator 18.

A motor (not shown) drives the rotor 16 from below pump 14 via a flex shaft 28; the flex shaft 28 is shown attached to the lower end of the rotor 16. The upper end of the flex shaft 28 orbits with the lower end of the rotor 16 while the flex shaft 28 lower end rotates concentrically with the motor shaft. As seen in FIG. 1, clearance is provided in the coupling 26 between the flex shaft 28 and rotor 16 to accommodate vertical force fluctuations experienced by the rotor 16 during pumping. A housing 30 encloses the flex shaft and provides a conduit for wellbore fluids flowing to the pump inlet 20.

SUMMARY OF THE INVENTION

Disclosed herein is an example of a progressing cavity pump for pumping wellbore production fluid. The pump may comprise a helical rotor, a pump inlet, a motor having an output shaft, a flex shaft mechanically coupling the output shaft and the helical rotor, a flex shaft housing circumscribing a portion of the flex shaft, and a passive gas separator provided in the flex shaft housing, the separator disposed generally parallel to the flex shaft. In one embodiment, the passive gas separator is gravity operated. The passive gas separator may extend substantially along the length of the flex shaft housing, or be about one half the length of the flex shaft or flex shaft housing. In one example the flex shaft housing comprises an outer housing circumscribing an inner housing, where an annulus is formed between the housings. Gas is separated in the annulus. A first set of fluid inlets may be formed through the outer housing and a second set of inlets can be formed through the inner housing, wherein the second set of inlets are disposed below the first set of inlets. The gas separator may include a first segment adapted to be in fluid communication with production fluid and extending in a first direction along a substantial portion of the flex housing and terminating at a second segment, where the second segment adapted to be in fluid communication with the first segment terminal end and the pump inlet. The first segment cross sectional area may be greater than the second segment cross sectional area. The first and second direction can be oriented substantially parallel with the flex shaft. Seals can be included between the inner housing and the outer housing; the seals disposed at the respective upper ends of the housings and respective lower ends of the housings.

Also disclosed herein is a system for pumping fluid from a well. The system may include a downhole progressing cavity pump having a helical rotor and a pump inlet, a pump motor, a flex shaft connecting the progressing cavity pump to the pump motor, a flex shaft housing having a sidewall containing fluid ports on an upper portion of the flex shaft housing, and an elongated gas/liquid separator disposed within the housing around the flex shaft. Optionally, the separator on one end is in fluid communication with the fluid ports and on a second end in fluid communication with the pump inlet, wherein well fluid entering the fluid ports flows in a substantially downward direction. Inner housing ports may be formed through the inner housing of the pumping system, where the ports provide fluid communication between the outer annulus and inner annulus. The inner housing ports can be disposed below the fluid ports.

A method for producing wellbore fluids is included herein. The method includes providing a pumping system in a wellbore. In one embodiment, pumping system comprises a progressing cavity pump having a pump inlet, a pump motor, a well fluid inlet, a flex shaft for driving the pump, the shaft coupled to the pump motor, and an elongate gas/liquid separator disposed around at least a portion of the flex shaft, the separator oriented substantially parallel with an axis of the pump. The method may further include energizing the motor, thereby activating the pump to draw fluid into the well fluid inlet and directing the fluid drawn into the well fluid inlet downwardly through the elongate gas/liquid separator then back upwardly, thereby separating gas from the fluid to form a separated fluid. Optionally, the fluid drawn into the well fluid inlet flows downwardly more than one half the length of the flex shaft or approximately the length of the flex shaft. The fluid may further optionally flow upwardly to the pump inlet more than one half the length of the flex shaft or approximately the length of the flex shaft.

DETAILED DESCRIPTION OF THE INVENTION

Figure 1:
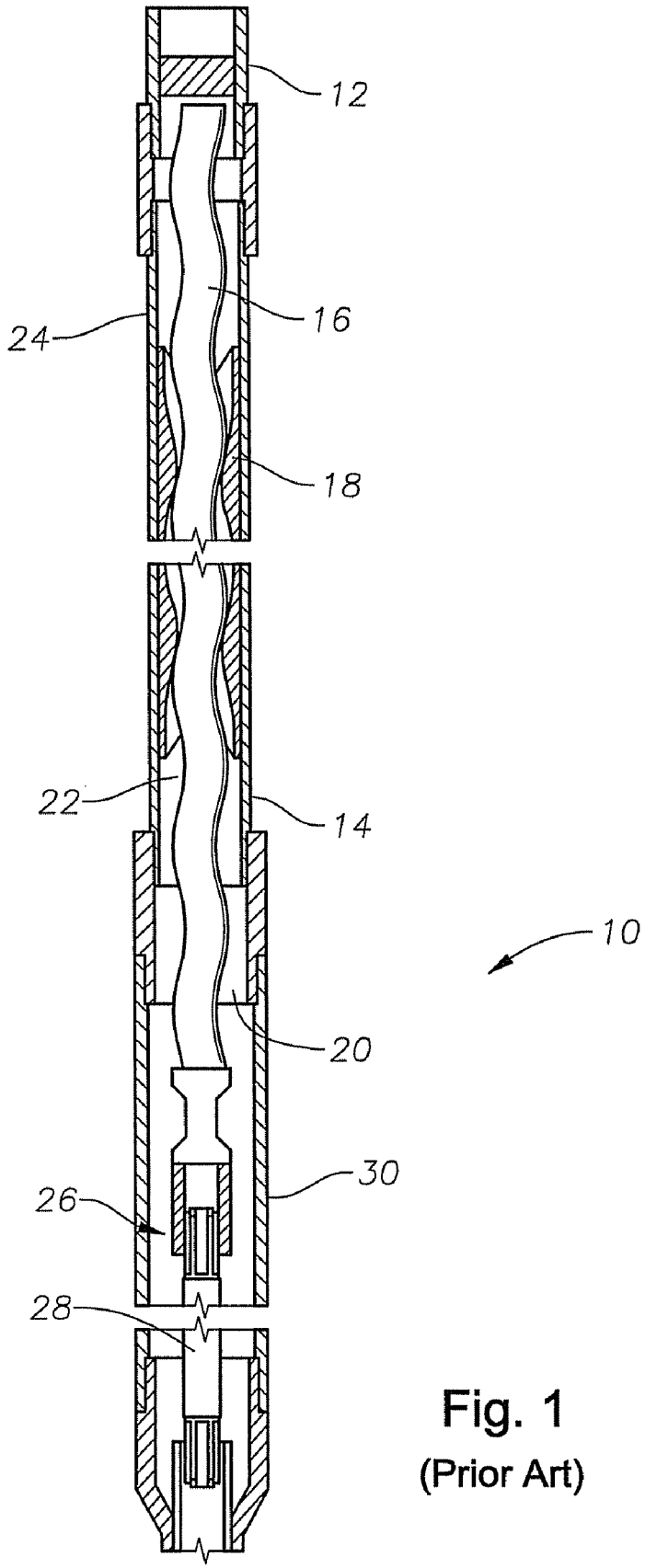
Fig. 1 (Prior Art)
FIG. 1 is a side partial cut-away view of a prior art progressing cavity pumping system.

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

Figure 2:
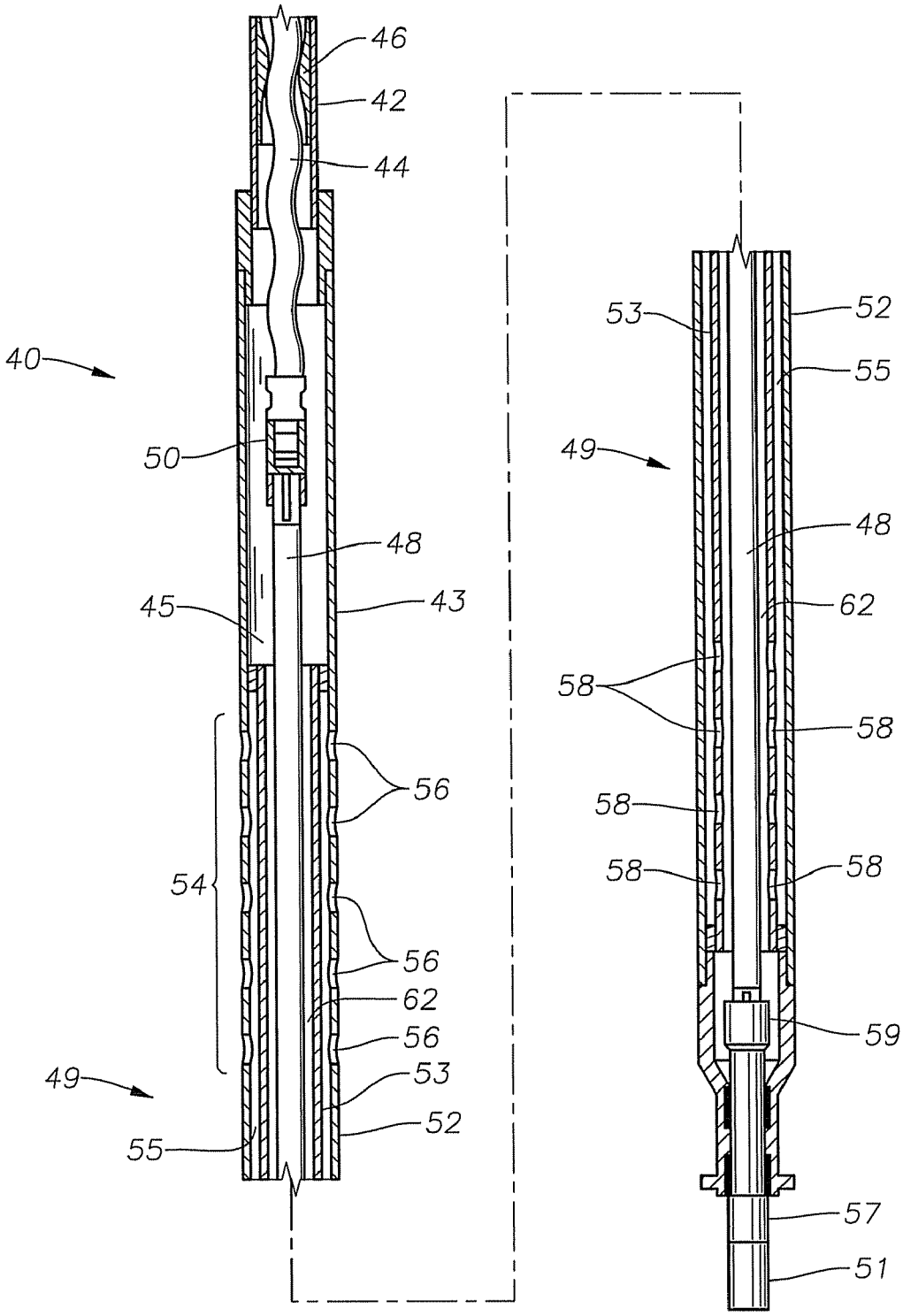
FIG. 2 is a side partial cut-away view of a portion of a progressing cavity pumping system having a gas/liquid separator.

FIG. 2 provides a side partial side cross sectional view of an embodiment of a progressing cavity pumping system 40 having a passive gas/liquid separator. The pumping system 40 of FIG. 2 comprises a progressing cavity pump 42 having a helical rotor 44 in pumping cooperation with an elastomeric stator 46. The rotor 44 is driven by a flex shaft 48 via a coupling 50 provided on the lower end of the rotor 44. Fluid pumped by the progressing cavity pump 42 enters the pump 42 through the pump inlet 45. The pump inlet 45 comprises the annular region between the flex shaft 48 and the pump housing 43. The flex shaft 48 is driven by a motor 51 and connected to the motor shaft through a lower coupling 59. A seal section 57 is provided between the motor 51 and the coupling 59.

A gas liquid separator 49 surrounds the flex shaft 48 below the pump 42, as illustrated in FIG. 2. In this embodiment, the gas/liquid separator 49 comprises an elongated passage 55 vertically oriented for separating gas and liquid. In operation, the fluid to be pumped by the progressing cavity pump 42 enters the system 40 through fluid entrance ports formed in the flex shaft outer housing 52. The flex shaft outer housing 52 extends between the motor 51 and the pump 42. More specifically, an outer housing inlet 54 is formed through flex shaft outer housing 52; the outer housing inlet 54 which comprises a plurality of passages or ports disposed along the upper portion of the flex shaft outer housing 52. Well fluid entering the outer housing inlet 54 at the upper end of the flex shaft outer housing 52 is then directed downward within the housing 52. The downward flow, combined with the operation of gravity and gas buoyancy, provides entrained gas separation from within the fluid as the flow turns downward. The gas separated within the downward flow migrates upward around the flex shaft inner housing 53 and ultimately flows out of the pumping system 40 through the ports 56 at the outer housing inlet 54. Some gas may still be entrained and flow downward in the flex shaft housing 52.

Further illustrated in FIG. 2 is a second or inner housing tubular 53 that circumscribes the flex shaft 48 and is disposed generally concentrically within the outer housing 52. The flex shaft 48 flexes radially within the inner housing 53. An inner annulus 62 is defined between the flex shaft 48 and inner housing 53. The inner housing 53 includes a plurality of ports 58 disposed at the lower end of the inner housing 53. When reaching the inner housing inlet 58, the well fluid flow turns upward, further separating gas. The separated gas migrates upward around the inner housing 53 in the downward flow. The well fluid is substantially free of gas as it flows through the ports and into the inner annulus 62 adjacent the flex shaft 48. After passing through the inner housing inlet 58, the well fluid surrounds the flex shaft 48 and flows upward within the inner housing 53 into the pump inlet 45 where it can then be pumped by the progressing cavity pump 42.

Figure 3:
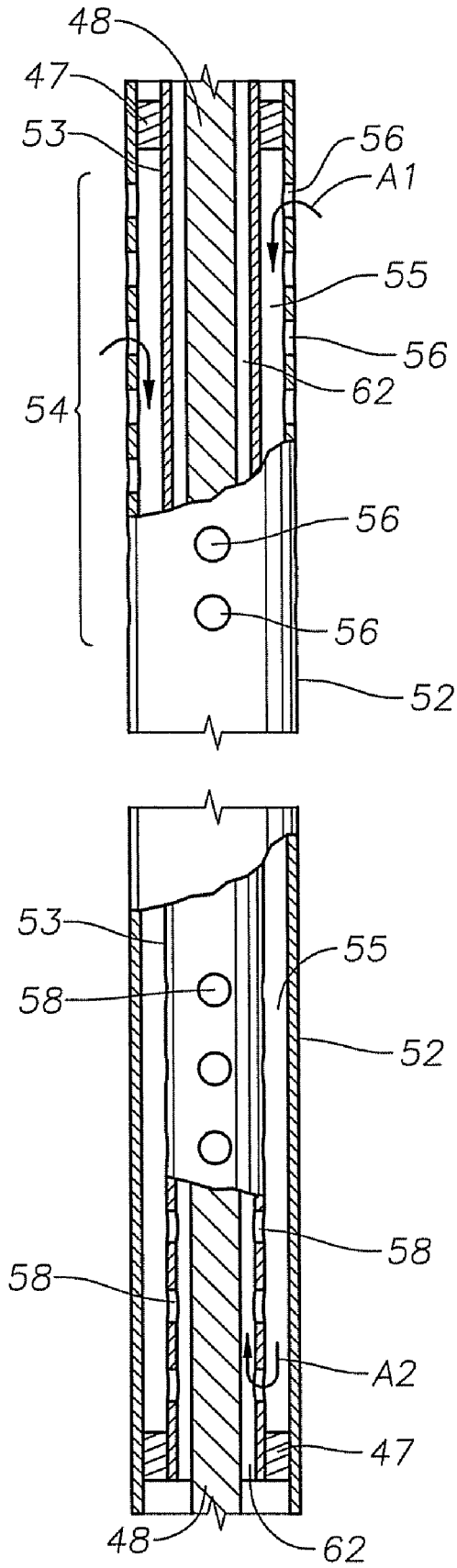
FIG. 3 is an expanded view of a section of the system of FIG. 2.

FIG. 3 provides a more detailed depiction in a side partial cross sectional view of the outer housing inlets 54. Here, outer housing ports 56 are formed at multiple locations lengthwise and radially on an upper region of the outer housing 52. As illustrated by arrow $A_1$, wellbore fluid flows into one of the ports 56 and downward in an outer annulus 55. The outer annulus 55 resides between the outer housing 52 and inner housing 53. It is within the outer housing 55 the wellbore fluid flows downward toward the ports 58 and where gas is passively and gravity separated from the liquid fractions of the wellbore fluid.

Arrow $A_2$ illustrates wellbore fluid flowing from the outer annulus 55 and into the inner annulus 62 through ports 58. As noted above, at this point the wellbore fluid should be substantially free of any intermixed or entrained gasses. As can be seen in FIG. 2, once within the inner annulus 62, the wellbore fluid can make its way upward within the housing to the pump inlet 45 for being pumped to the surface by the progressing cavity pump 42. The gas/liquid separator 49 comprises the outer and inner annulus (55, 62) and their corresponding fluid ports (56, 58).

Seals 47 may optionally be provided between flex shaft housings 52, 53 at the upper and lower terminal ends of the outer annulus 55. Thus, in one embodiment, the flex shaft housing comprises both the inner and outer housings 52, 53. Optionally, the cross sectional area of the outer annulus 55 is greater than the cross sectional area of the inner annulus 62. This not only accommodates for the added volumetric flow rate of the mix of gas and liquid as it enters the upper portion of the outer annulus 55, but also limits the fluid flow velocity within the outer annulus 55, thereby providing additional time to separate gas from liquid within the wellbore fluid.

In the embodiment shown, the gas separator 49 operates in a passive manner allowing gravity and buoyancy forces to separate the gas and liquid fractions of the wellbore fluid. Although the passive gas separator is shown extending substantially the length of the flex shaft housing 52, other embodiments exist where the separator 49 length exceeds the flex shaft 48 length such that the upper end with entrance ports is above the upper end of the flex shaft and the lower end with transfer ports is below the lower end of the flex shaft. Optionally, the separator 49 can have a length substantially less than flex shaft 48 and be disposed along a portion of the flex shaft 48. For example, the separator 49 length can be approximately equal to the flex shaft 48 length, or can be approximately one half the flex shaft 48 length.

In another embodiment, the inlet for the wellbore fluid to the pumping system 40 comprises a gallery opening extending substantially around the entire circumference of the outer housing 52 instead of the individual ports 56 as shown. The gallery embodiment may also exist for the inner housing inlet 58 between the inner and outer annulus (55, 62). Although the flow through the gas separator 49 is substantially aligned with the axis of the system 40, direction vanes may be disposed within the annulus to direct the flow in a helical or otherwise oblique direction thereby extending the travel path of the fluid along the gas separator 49.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims. While the invention has been shown in only one of its forms, it should be apparent to those skilled in the art that it is not so limited but is susceptible to various changes without departing from the scope of the invention.

The invention claimed is:

1. A progressing cavity pump system for pumping wellbore production fluid comprising:

a helical rotor;

a pump having an inlet;

a motor having an output shaft;

a flex shaft mechanically coupling the output shaft and the helical rotor;

a flex shaft inner housing circumscribing a portion of the flex shaft;

an inner annulus between the flex shaft inner housing and the flex shaft;

a flex shaft outer housing circumscribing a portion of the flex shaft inner housing;

an outer annulus between the flex shaft inner housing and flex shaft outer housing; and inlets formed through the flex shaft inner housing, thereby providing fluid communication between the inner annulus and outer annulus through the flex shaft inner housing.

2. The progressing cavity pump system of claim 1, further comprising an elastomeric stator circumscribing the rotor.

3. The progressing cavity pump system of claim 1, wherein the outer annulus extends substantially along the length of the flex shaft housing.

4. The progressing cavity pump system of claim 1, wherein the helical rotor comprises an elongated helically shaped shaft.

5. The progressing cavity pump system of claim 1, further comprising outer formed through the flex shaft outer housing that are disposed above the inlets in the flex shaft inner housing.

6. The progressing cavity pump system of claim 5, wherein the outer housing and outer inlets define a first segment adapted to be in fluid communication with production fluid and extending in a first direction alone a substantial portion of the flex housing and the inner housing and inner inlets define a second segment that extends in a second direction along a substantial portion of the flex housing, where the second segment is adapted to be in fluid communication with the first segment and the pump inlet, where the first segment cross sectional area is greater than the second segment cross sectional area.

7. The progressing cavity pump system of claim 6, wherein the first and second direction are substantially parallel with the flex shaft.

8. The progressing cavity pump system of claim 4, further comprising seals between the inner housing and the outer housing disposed at the respective upper ends of the housings and respective lower ends of the housings.

9. A system for pumping fluid from a well, comprising:

a downhole progressing cavity pump having a helical rotor and a pump inlet;

a pump motor;

a flex shaft connecting the progressing cavity pump to the pump motor; and an elongated gas/liquid separator comprising:

a flex shaft housing having a sidewall containing fluid ports on an upper portion of the flex shaft housing, and an inner housing around the flex shaft having ports formed therethrough below the fluid ports on the upper portion of the flex shaft housing, so that when fluid flows through the fluid ports on the upper portion of the flex shaft housing, the fluid flows downward between the flex shaft housing and the inner housing, through the ports in the sidewall of the inner housing, and then upward to the pump inlet.

10. The system of claim 9, wherein the well fluid downward flow is substantially along the flex shaft length.

11. The system of claim 9, wherein the separator further comprises an inner annulus between the inner housing and flex shaft and an outer annulus between the inner housing and the flex shaft housing.

12. The system of claim 11, wherein the helical rotor comprises an elongated helically shaped shaft.

13. The system of claim 9, further comprising seals between the inner housing and the flex shaft housing disposed at the respective upper ends of the housings and respective lower ends of the housings.

* * * * *

UNITED STATES PATENT AND TRADEMARK OFFICE

CERTIFICATE OF CORRECTION

PATENT NO. : 7,798,211 B2
APPLICATION NO. : 12/125160
DATED : September 21, 2010
INVENTOR(S) : Donn J. Brown et al.

It is certified that error appears in the above-identified patent and that said Letters Patent is hereby corrected as shown below:

Column 6, line 2, insert --inlets-- after "outer"

Signed and Sealed this
Twenty-fifth Day of January, 2011

David J. Kappos

David J. Kappos
*Director of the United States Patent and Trademark Office*